US006283203B1

(12) United States Patent
Eilertsen

(10) Patent No.: US 6,283,203 B1
(45) Date of Patent: Sep. 4, 2001

(54) DEVICE FOR PREVENTING PIPE BUCKLING

(75) Inventor: Bjørn Eilertsen, Hundvåg (NO)

(73) Assignee: Engineering and Drilling Machinery AS (NO)

( * ) Notice: Subject to any disclaimer, the term of this patent is extended or adjusted under 35 U.S.C. 154(b) by 0 days.

(21) Appl. No.: 09/530,511

(22) PCT Filed: Oct. 30, 1998

(86) PCT No.: PCT/NO98/00322

§ 371 Date: Apr. 28, 2000

§ 102(e) Date: Apr. 28, 2000

(87) PCT Pub. No.: WO99/23347

PCT Pub. Date: May 14, 1999

(30) Foreign Application Priority Data

Oct. 31, 1997 (NO) ..... 5016/97

(51) Int. Cl.[7] ..... E21B 19/08; E21B 19/24

(52) U.S. Cl. ..... 166/77.1; 166/85.5; 175/220

(58) Field of Search ..... 166/77.1, 77.2, 166/77.3, 77.4, 85.5, 379; 175/220

(56) References Cited

U.S. PATENT DOCUMENTS

| | | | | |
|---|---|---|---|---|
| 3,402,777 | | 9/1968 | Watson . | |
| 3,757,858 | | 9/1973 | Davis et al. . | |
| 3,797,570 | * | 3/1974 | Leutwyler | 166/77 |
| 4,250,973 | | 2/1981 | Hall . | |
| 4,260,029 | | 4/1981 | Morrison et al. . | |
| 5,115,861 | | 5/1992 | Laky . | |
| 5,309,990 | * | 5/1994 | Lance | 166/77 |
| 5,454,419 | * | 10/1995 | Vloedman | 166/277 |
| 5,595,248 | * | 1/1997 | Denny | 166/379 |
| 5,890,534 | * | 4/1999 | Burge et al. | 166/77.3 |

* cited by examiner

*Primary Examiner*—Hoang Dang
(74) *Attorney, Agent, or Firm*—Cowan, Liebowitz & Latman, P.C.; Michael I. Wolfson

(57) ABSTRACT

An apparatus for preventing pipe buckling when downwardly directed axial forces are applied to a pipeline (3) which extends from a derrick (1) down into a well bore, especially when snubbing. The apparatus comprises two sets of pipe supports (8) linked together to give a continuous chain (10), which is arranged to extend from a respective guide rail (6, 7) in the derrick (1) to the pipeline (3), and the pipe supports (8) are movably arranged in the guide rail (6, 7) parallel to the pipeline (3). The guide rail (6, 7) extends in a general U-shape with the U-bend **(6*c*, 7*c*) located closest to the lower end of the derrick (1) and comprises two legs (6*a*, 6*b*, 7*a*, 7*b*), of which a first leg (6*a*, 7*a*) is arranged close to the pipeline (3) and a second leg (6*b*, 7*b*) is arranged at a greater distance from the pipeline. The pipe supports (8) are designed to be placed in the first leg (6*a*, 7*a*) when operative, and are designed to be transferred to the second leg (6*b*, 7*b*)** when they are to be rendered inoperative.

14 Claims, 5 Drawing Sheets

DEVICE FOR PREVENTING PIPE BUCKLING

BACKGROUND OF THE INVENTION

The present invention relates to an apparatus for preventing pipe buckling when downwardly directed axial forces are applied to a pipeline which extends from a derrick down into a well bore, especially when snubbing.

Snubbing is carried out when a drill pipe or production tubing must be forced down into the well against well pressure, and the well pressure is so great that the pipe does not run down by virtue of its own weight. A axial force is then applied to the pipe, forcing the pipe down against well pressure. During snubbing of this kind there is a danger that the pipe might buckle sideways halfway between the top drive, which holds the pipe at its upper end, and the drill deck. The buckling may be so great that the pipe breaks.

In the case of a pipeline consisting of pipes having a diameter of 2⅞" (7.3 cm), the buckling length during snubbing is about 70 cm. This means that the pipe must be gripped at intervals of 70 cm in order to apply an axial force. In the case of a pipe length in the derrick, between the drill deck and the top drive, of a total of 9 m, this means that the pipe must be gripped about 13 times to prevent the pipe from breaking. Of course, this takes considerably longer than it would had it been possible to run down the whole pipe length in the derrick at one go.

SUMMARY OF THE INVENTION

The object of the present invention is to make this possible. In order to secure this object, the apparatus comprises a plurality of pipe supports which are arranged to extend from a guide rail in the derrick to the pipeline, and the pipe supports are movably arranged in the guide rail parallel to the pipeline.

BRIEF DESCRIPTION OF THE DRAWINGS

A preferred embodiment of the present invention will now be described with reference to the accompanying drawings, wherein.

BRIEF DESCRIPTION OF THE PREFERRED EMBODIMENTS

Figure 1:
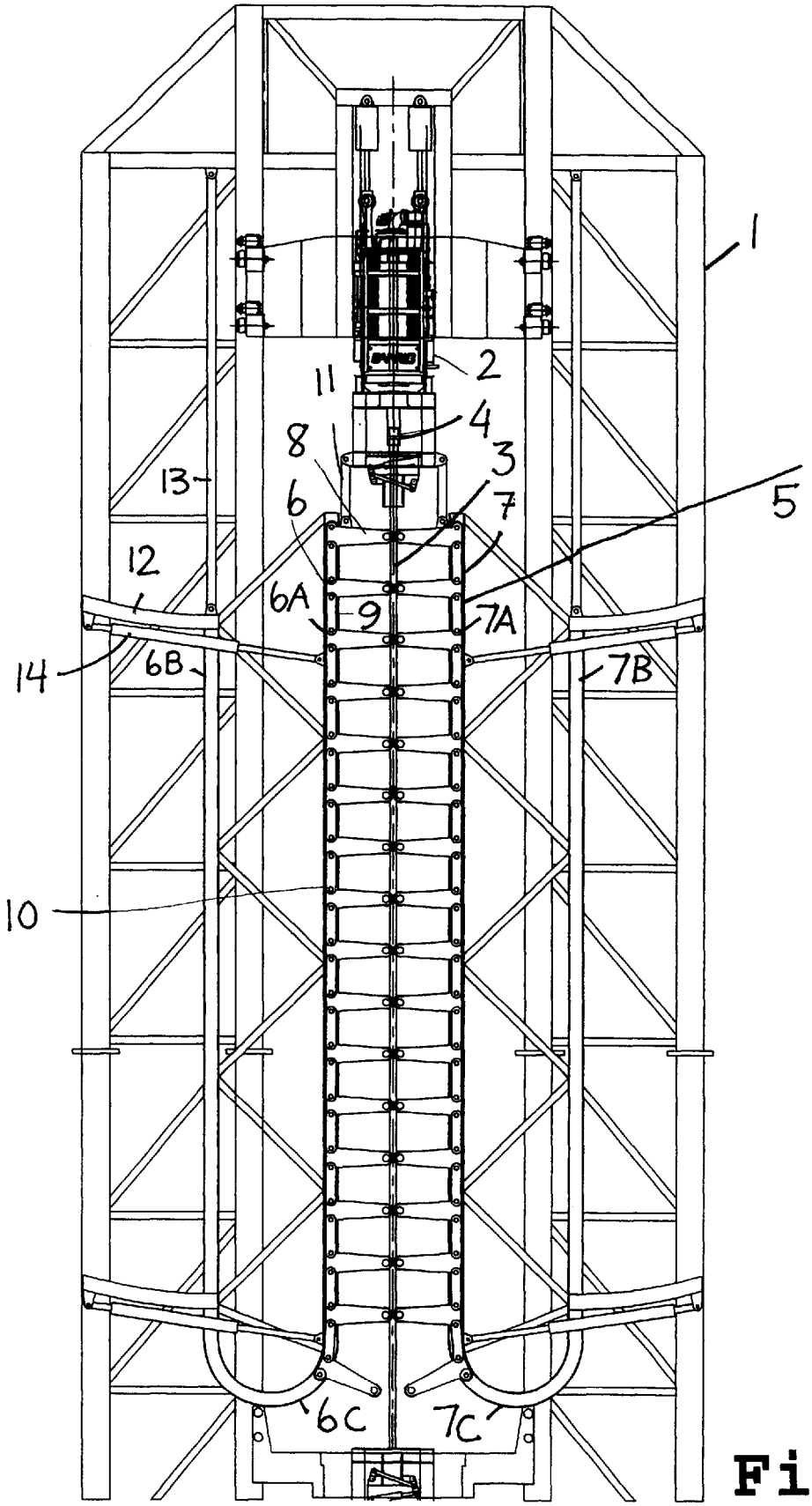
FIG. 1 shows a derrick equipped with an apparatus according to the invention, with pipe supports in engagement with the pipeline.

FIG. 1 is a schematic illustration of a derrick 1, in which there is located a top drive 2, which is arranged to grip a pipeline 3 at the upper end thereof with the aid of a holder 4. FIG. 1 also shows an apparatus 5 in accordance with the present invention. The apparatus 5 comprises a pair of guide rails 6 and 7, each being generally U-shaped and including legs 6*a*, 7*a*, 6*b*, 7*b* and a U-bend 6*c*, 7*c*. In the illustrated exemplary embodiment, the legs 6*a*, 6*b*, 7*a*, 7*b* are parallel.

A plurality of pipe supports 8 are movably arranged in the guide rails 6 and 7 and are linked together via articulations 9 to give a continuous pipe support chain 10.

The pipe support chain 10 is connected via an articulation 11 to the top drive 2 and follows this during the vertical movements thereof.

Figure 2:
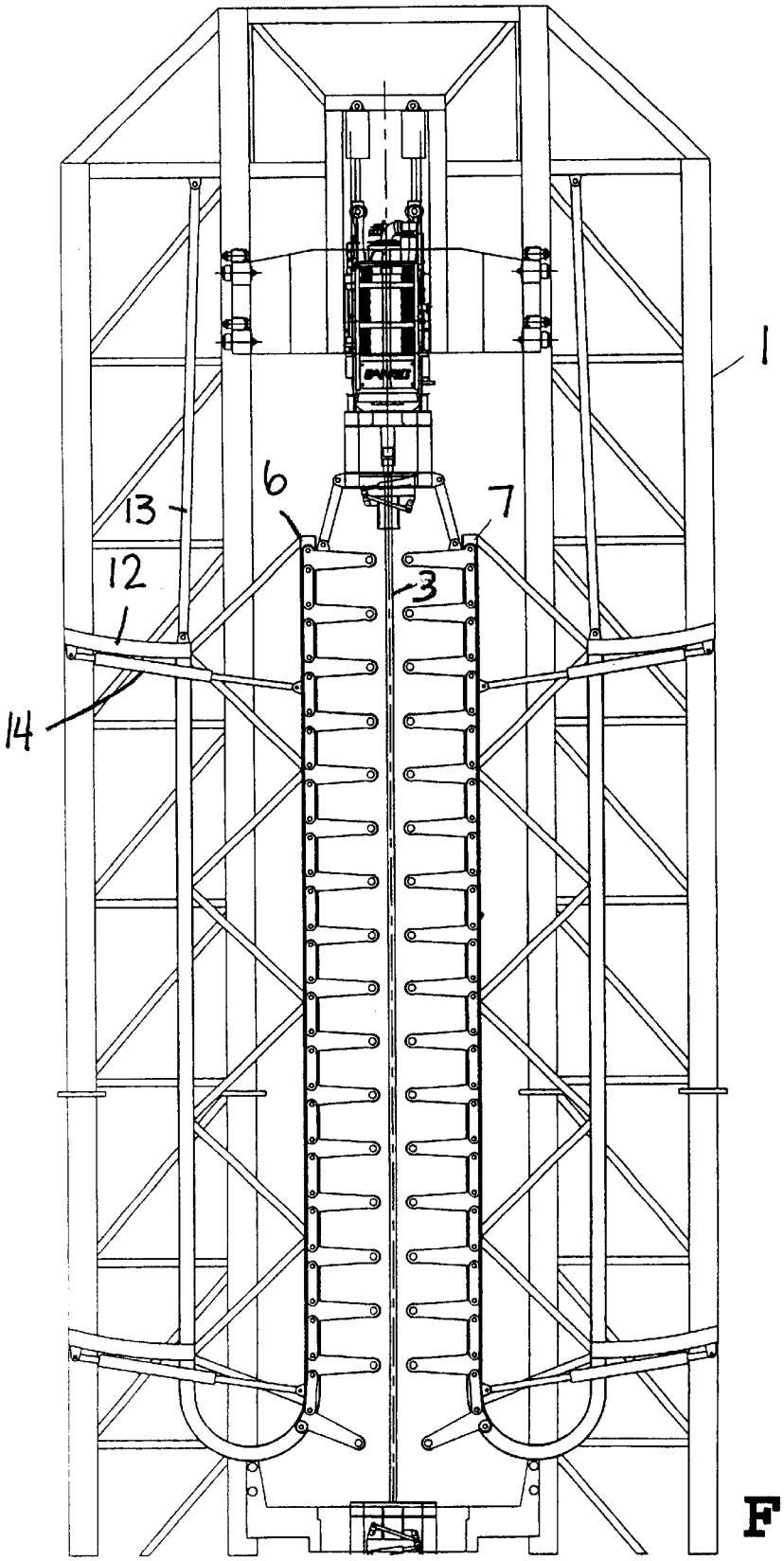
FIG. 2 shows the apparatus according to FIG. 1, with the pipe supports pulled away from the pipeline.

The guide rails 6 and 7 are suspended in the derrick via suspension rails 12, suspension stays 13 and hydraulic cylinders 14. There is a total of four suspension rails 12, two suspension stays 13 and four hydraulic cylinders 14. The hydraulic cylinders 14 are arranged to pull the guide rails 6 and 7 away from the pipeline 3 and move the guide rails 6 and 7 back towards the pipeline 3 again. The guide rails 6, 7 engage with nonillustrated rollers in the suspension rails 12 and roll along these when they are moved away from and towards the pipeline 3. The suspension stay 13 is pivotally arranged in the derrick 1. In FIG. 2, the guide rails 6 and 7 are moved a small distance away from the pipeline 3.

Figure 3:
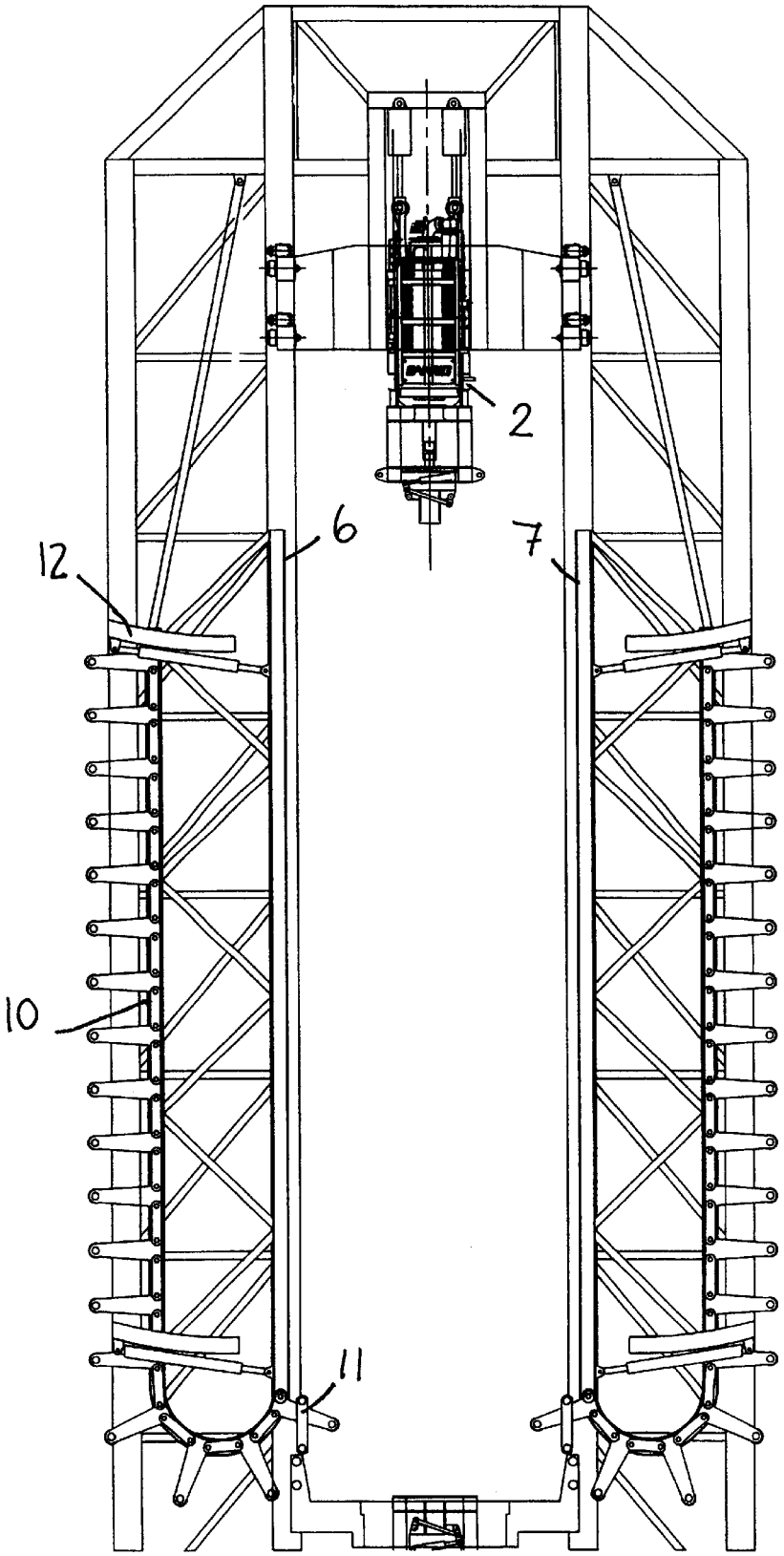
FIG. 3 shows the apparatus according to FIGS. 1 and 2 where the pipe supports have be moved completely out of the path of travel of the top drive.

In FIG. 3 the guide rails 6 and 7 are moved completely out of the path of travel of the top drive 2. The guide rails 6 and 7 are then moved towards the extreme end of the suspension rails 12, and the pipe support chain 10 is moved from the guide rail leg 6*a*, 7*a*, via the U-bend 6*c*, 7*c* to the guide rail leg 6*b*, 7*b*. The articulation 11 is disconnected from the top drive 2. It is now possible to carry out operations in the derrick which do not require the apparatus according to the invention, and where the apparatus will not be in the way either.

Figure 4:
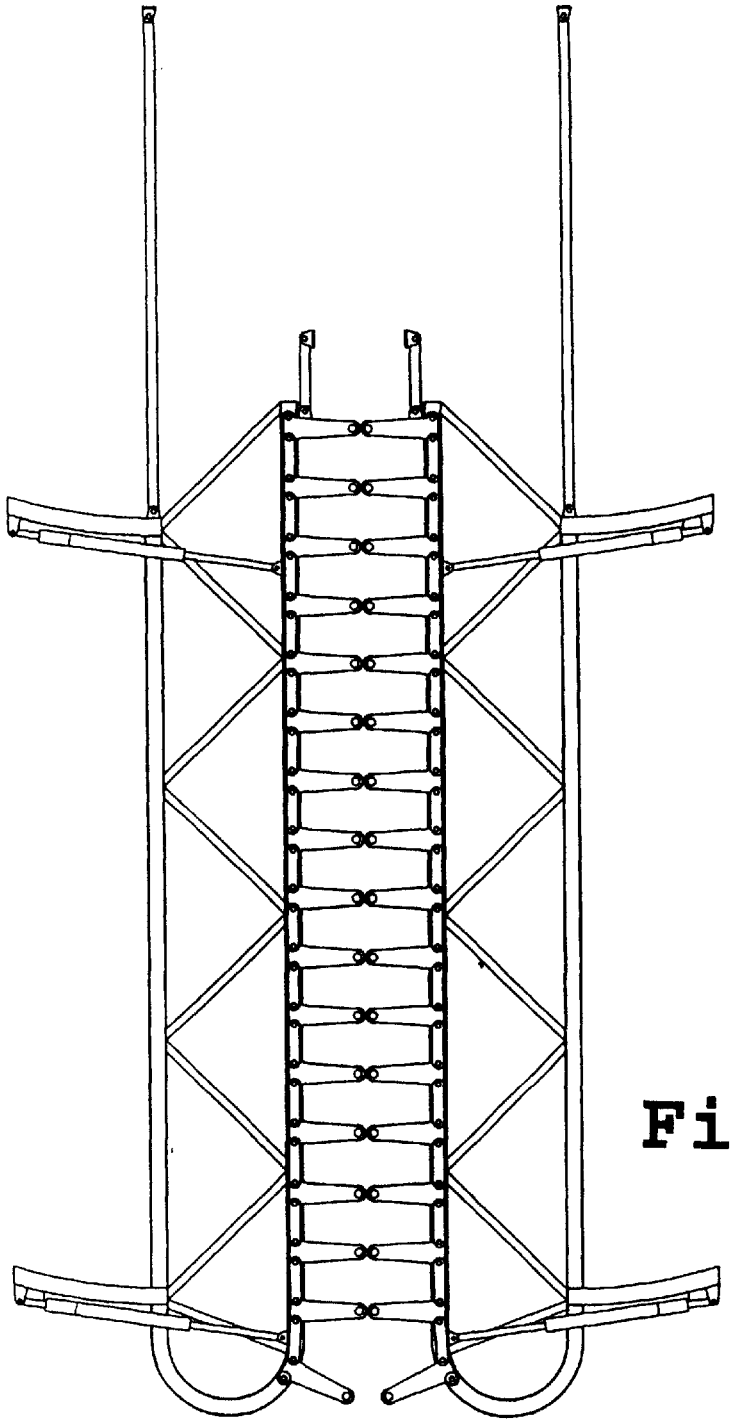
FIG. 4 shows the apparatus according to the invention removed from the derrick.

FIG. 4 shows the apparatus according to the invention removed from the derrick to better illustrate the details thereof.

Figure 5:
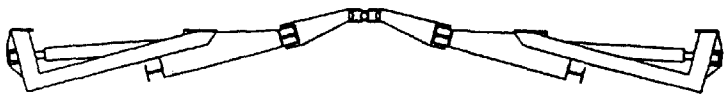
FIG. 5 shows the apparatus according to the invention seen from above.

FIG. 5 shows the apparatus of the invention from above, and here the same reference numerals are used for the same parts as in the preceding figures.

Figure 6:
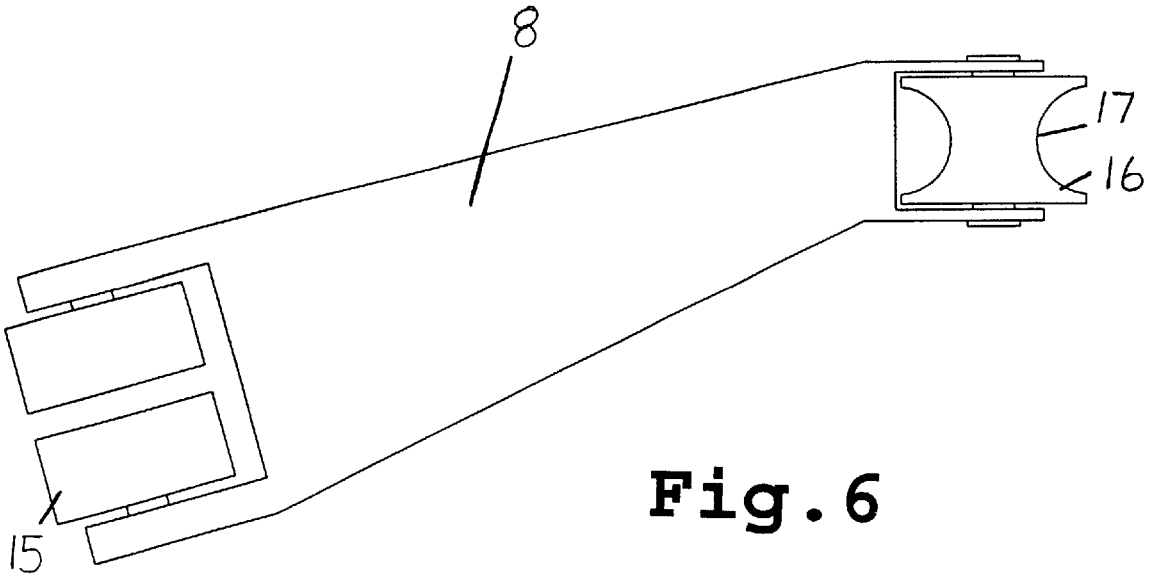
FIG. 6 is a detailed view of a pipe support.

FIG. 6 shows a pipe support in detail. The pipe support 8 comprises guide rail rollers 15, which are arranged for engagement with the guide rail 6, 7 at one end thereof, and at the opposite end thereof comprises a roller 16 having a concave surface 17 for contact with the pipeline 3.

When the apparatus according to the invention is in use, the situation shown in FIG. 1 arises. The pipe supports 8 will be pressed against the pipeline 3 with a force determined by the hydraulic pressure of the cylinders 14. Owing to the concave surface 17 of the rollers 16, the pipeline 3 will in fact be prevented from buckling transverse to the longitudinal extent of the pipe supports 8, even though pipe supports 8 are only arranged in pairs. As the top drive 2 presses the pipeline 3 downwards, the top drive 2 will move downwards in the derrick. Since the pipe support chain 10 is physically connected to the top drive 2, the pipe support chain 10 will also move downwards together with the pipeline 3. As the pipe support chain 10 moves downwards, the lowermost pipe supports 8 will be pushed into the U-bend 6*c*, 7*c* and then upwards in the guide rail leg 6*b*, 7*b*.

It is preferable to attempt to position the pipe connections in the spaces between two pipe supports 8, but it is also possible to equip the pipe supports with an elastic device, so that the pipe supports which may come to bear against a pipe connection, spring slightly backwards relative to the other pipe supports.

Owing to the rollers 16, there will be no sliding movement between the pipeline and the pipe supports even though there might be a certain relative movement therebetween, for example, because of slack, compression of the pipe or the like.

The embodiment described above is merely intended to serve as an exemplary embodiment, and changes may of course be made to this within the scope of the present invention. For instance, the pipe supports do not necessarily need to be linked together in a continuous chain, but they could move individually and synchronously by means of, for example, small motors positioned in connection with each pipe support. In that case, the pipe supports do not necessarily need to be physically connected to the top drive, but synchronisation therewith may, for example, be attained by means of an electronic control. The guide rails may also be suspended in the derrick in some other way, or be fixedly mounted therein, the pipe supports then preferably being designed telescopically, so that their outer ends can be pulled away from the pipeline.

What is claimed is:

1. An apparatus for preventing pipe buckling when downwardly directed axial forces are applied to pipeline (3) which extends from a derrick (1) down into a well bore, comprising a derrick (1) having at least one guide rail and a plurality of pipe supports (8) which are arranged to extend from a guide rail (6, 7) in the derrick (1) to the pipeline (3), and that the pipe supports (8) are movably arranged in the guide rail (6, 7) parallel to the pipeline (3), characterised in that the pipe supports (8) are linked together to give at least one continuous chain (10), wherein the guide rail (6, 7) extends in a general U-shape with the U-bend **(6*c*, 7*c*) located closest to the lower end of the derrick (1) and that the pipe supports (8) are arranged to be moved out of contact with the pipeline (3) by being transferred into the U-bend (6*c*, 7*c*)**.

2. The apparatus according to claim 1, characterised in that it comprises two sets of pipe supports (8) which are arranged to extend from guide rails (6, 7) placed on opposite side of the pipeline (3).

3. The apparatus according to claims 1, characterised in that the guide rail (6, 7) comprises two legs **(6*a*, 6*b*, 7*a*, 7*b*), of which a first leg (6*a*, 7*a*) is arranged close to the pipeline (3) and a second leg (6*b*, 7*b*) is arranged at a greater distance from the pipeline, the pipe supports (8) being designed to be placed in the first leg (6*a*, 7*a*) when operative and designed to be transferred to the second leg (6*b*, 7*b*)** when they are to be rendered inoperative.

4. The apparatus according to any claim 1, characterised in that the guide rail (6, 7) is movable transverse to the axis of the pipeline (3).

5. The apparatus according to claim 1, characterised in that the guide rail (6, 7) is suspended in at least one suspension rail (12) which extends generally transverse to the guide rail (6, 7).

6. The apparatus according to claim 1, characterised in that the guide rail (6, 7) is suspended in at least one suspension stay (13), which is pivotally supported in the derrick (1).

7. The apparatus according to claim 1, characterised in that the pipe supports (8) are connected to a top drive (2) in such a way that the pipe supports (8) follow the vertical movement of the top drive (2).

8. The apparatus according to claim 1, characterised in that each of the pipe supports (8) at each of their ends facing the pipeline (3) is equipped with at least one roller (16) having a concave contact face (17) against the pipeline (3).

9. The apparatus according to claim 3, characterised in that it comprises two sets of pipe supports (8) which are arranged to extend from guide rails (6, 7) placed on opposite sides of the pipeline (3).

10. The apparatus according to claim 3, characterised in that the guide rail (6, 7) is moveable transverse to the axis of the pipeline (3).

11. The apparatus according to claim 3, characterised in that the guide rail (6, 7) is suspended in at least one suspension rail (12) which extends generally transverse to the guide rail (6, 7).

12. The apparatus according to claim 1, characterised in that the guide rail (6, 7) is suspended in at least one suspension stay (13), which is pivotally supported in the derrick (1).

13. An apparatus according to claim 1, characterised in that the pipe supports (8) are connected to a top drive (2) in such a way that the pipe supports (8) follow the vertical movement of the top drive.

14. The apparatus according to claim 1, characterised in that each of the pipe supports (8) at each of their ends facing the pipeline (3) is equipped with at least one roller (16) having a concave contact face (17) against the pipeline (3).

* * * * *